US005263331A

United States Patent [19]

Sergius

[11] Patent Number: 5,263,331

[45] Date of Patent: Nov. 23, 1993

[54] REFRIGERANT RECOVERY AND RECYCLING SYSTEM

[75] Inventor: David W. Sergius, Burnaby, Canada

[73] Assignee: Polar Industries Ltd., Coquitlam, Canada

[21] Appl. No.: 974,269

[22] Filed: Nov. 10, 1992

[51] Int. Cl.[5] ..... F25B 45/00

[52] U.S. Cl. ..... 62/77; 62/85; 62/475; 62/292

[58] Field of Search ..... 62/77, 85, 195, 149, 62/292, 475, 474

[56] References Cited

U.S. PATENT DOCUMENTS 4,646,527 3/1987 Taylor ..... 62/85

5,038,578 8/1991 Manz et al. ..... 62/292

OTHER PUBLICATIONS

Mechanical Buyer & Specifier, Oct. 1992, 3 pages.

David Sergius, "Coquitlam firm breathes easier with lucrative CFC recycler", Vancouver Sun, Feb. 14, 1992, 1 page.

Leslie Ellis, "Polar Industries develops Freon recovery system", Profile (the Jul./Aug. 1990 issue of Discovery magazine), 1 page.

*Primary Examiner*—John M. Sollecito

*Attorney, Agent, or Firm*—Darby & Darby

[57] ABSTRACT

A refrigerant recovery and recycling system recovers refrigerant from refrigeration equipment, removing contaminants, for storage and eventual reuse. The system includes a separation unit in which the refrigerant is separated from the contaminants, preferably by distillation which is at least partially driven by waste heat produced by the compressor which compresses the refrigerant for storage.

5 Claims, 6 Drawing Sheets

REFRIGERANT RECOVERY AND RECYCLING SYSTEM

FIELD OF THE INVENTION

The present invention relates to a method of recovering and recycling refrigerants such as chlorofluorocarbon compounds (CFCs) from refrigeration and air conditioning devices.

The present invention also relates to an apparatus for recovering and recycling refrigerants such as CFC compounds.

BACKGROUND OF THE INVENTION

Most modern refrigeration equipment employs one of several organic solvent compositions, such as chlorofluorocarbon compounds (CFCs), as a working fluid (refrigerant).

For various reasons, such as wearing of the seals in the refrigeration equipment's compressor, the refrigerants in the equipment may eventually become contaminated with dirt, oil and/or moisture. These contaminants affect the efficiency of the equipment and may eventually lead to damage of the compressor and other components in the equipment. Thus, it is typically required that the refrigerant in the equipment be replaced at intervals to avoid damage to the equipment and to restore the equipment's overall efficiency. Also, in the event of a failure of the equipment, it is typically required that the refrigerant be removed from the equipment prior to servicing.

Previously, the most common method of removing the refrigerant from the equipment was to vent the refrigerant into the atmosphere and to replace it with virgin refrigerant as required. However, problems exist with this method of removing the refrigerant.

The release of CFC compounds into the atmosphere results in the depletion of the ozone layer therein. As the ozone layer is the principal filter in the atmosphere for removing the sun's ultraviolet radiation, much concern has been expressed about its depletion as it is expected to lead to many problems. For example, it is expected that an upturn in related health problems such as skin cancer will occur. Accordingly, many governments are passing legislation restricting or prohibiting the use of and/or release of CFC compounds into the atmosphere. These restrictions pose a serious problem to refrigeration equipment manufacturers and servicers who no longer can release CFC-type refrigerants into the atmosphere.

A second problem in regard of venting of refrigerants to the atmosphere exists, albeit one with a lesser impact, is the fact that the virgin refrigerant compounds required for replacement of vented refrigerants are expensive and, in the case of CFCs, may be difficult to obtain.

SUMMARY OF THE INVENTION

It is an object of the present invention to provide a novel method for the recovery and recycling of refrigerant compounds.

It is a further object of the present invention to provide a novel apparatus for recovering and recycling refrigerant compounds.

According to one aspect of the present invention, there is provided a method of recovering and recycling refrigerant from refrigeration equipment comprising the steps of: connecting a separation unit to said equipment through a first valve means; drawing gas from said separation unit to create a reduced pressure in said separation unit, said reduced pressure inducing flow of refrigerant and contaminants from said equipment into said separation unit; pressurizing said gas drawn from said separation unit into a storage vessel through a second valve means; and closing said first and second valve means to drain the contaminants remaining in the separation unit after said refrigerant has been recovered.

Preferably, the method further comprises the step of monitoring the level of fluid in said separation unit and closing said first valve means for a predetermined time when a predefined level in said separation unit is exceeded while continuing to draw gas from said separation unit. Also preferably, the method further includes the step of evacuating any remaining refrigerant from said separation unit when said first and second valve means have been closed. It is also preferred that the liquid refrigerant and contaminants drawn into the separation unit are distilled therein and that this distillation is aided by waste heat from said pressurized gas.

According to another aspect of the present invention, there is provided apparatus for recovering and recycling refrigerant compounds from refrigeration equipment comprising: a separation unit for separating refrigerant from contaminants; first valve means operable to connect said separation unit to said refrigeration equipment; means to draw gas from said separation unit to create a reduced ambient pressure therein, said reduced ambient pressure drawing refrigerant and contaminants from said equipment to said separation unit; means to pressurize said gas drawn from said separation unit; means to remove contaminants from said separation unit; and second valve means operable to supply said pressurized gas to a storage vessel.

Preferably, the separation unit includes a refrigerant inlet which is spaced from a refrigerant outlet to allow particulate contaminants to settle from gaseous refrigerant prior to its entering the refrigerant outlet. Also preferably, the separation unit further includes heating means to heat liquid refrigerant drawn into the separation unit. Also preferably, the means to draw gas from the separation unit and the means to pressurize said drawn gas comprise a compressor.

BRIEF DESCRIPTION OF THE DRAWINGS

A preferred embodiment of the present invention will now be described, by way of example only, with reference to the attached figures wherein.

DETAILED DESCRIPTION OF THE PREFERRED EMBODIMENT

Figure 1:
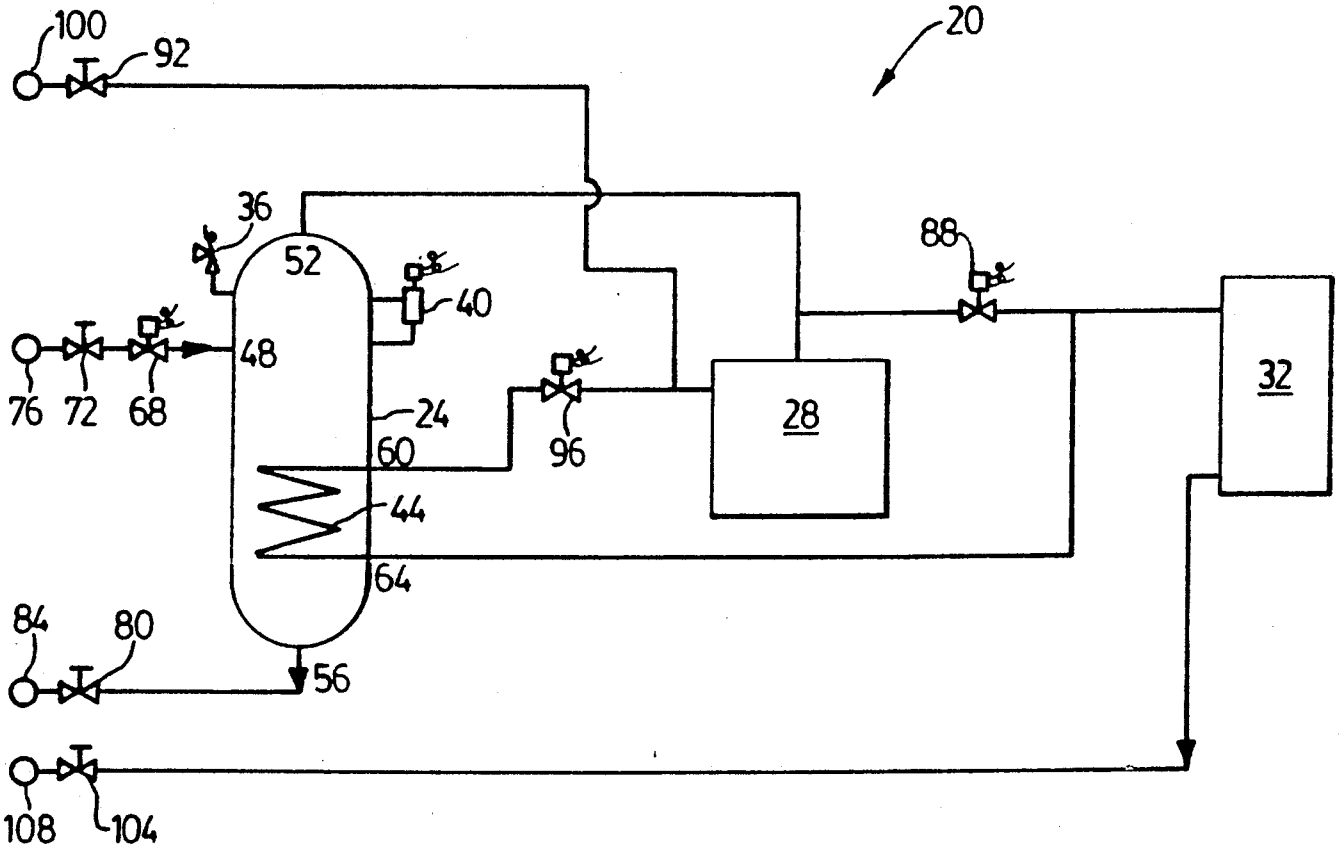
FIG. 1 shows a schematic representation of a recovery and recycling system in accordance with the present invention.

A schematic representation of a recovery and recycling system in accordance with the present invention is indicated generally at 20 in FIG. 1. The system includes a recovery and separation unit 24, a compressor 28, and a condenser 32. Recovery and separation unit 24 is a pressure vessel suitable for containing a vacuum and includes a pressure relief valve 36, a level sensor 40 and a heating coil 44. Recovery and separation unit 24 also includes a product inlet 48, a product outlet 52 and a contaminant outlet 56. Heating coil 44 is located within recovery and separation unit 24 is connected between an inlet 60 and an outlet 64 mounted thereon.

Product inlet 48 is connected to a product-in control solenoid valve 68 which is in turn connected to a product-in control valve 72. Control valve 72 is connected to a suitable pressure connector 76, such as a female ¼" connector.

Similarly, contaminant outlet 56 is connected to a contaminant-out control valve 80 and a suitable drainage connector 84. Contaminant-out control valve 80 enables the draining of collected contaminants from recovery and separation tank 24 as required.

Product outlet 52 is connected to the low pressure side of compressor 28 and to one side of an evacuation solenoid valve 88. The high pressure side of compressor 28 is connected to an evacuation control valve 92 and to one side of a discharge solenoid valve 96. Evacuation control valve 92 is connected to a suitable pressure connector 100 while the other side of discharge solenoid valve 96 is connected to heating coil inlet 60.

The other side of evacuation solenoid valve 88 is connected to the inlet of condenser 32 and to outlet 64 of heating coil 44. The outlet of condenser 32 is connected to a product-out control valve 104, which is in turn connected to a suitable pressure connector 108.

Figure 2:
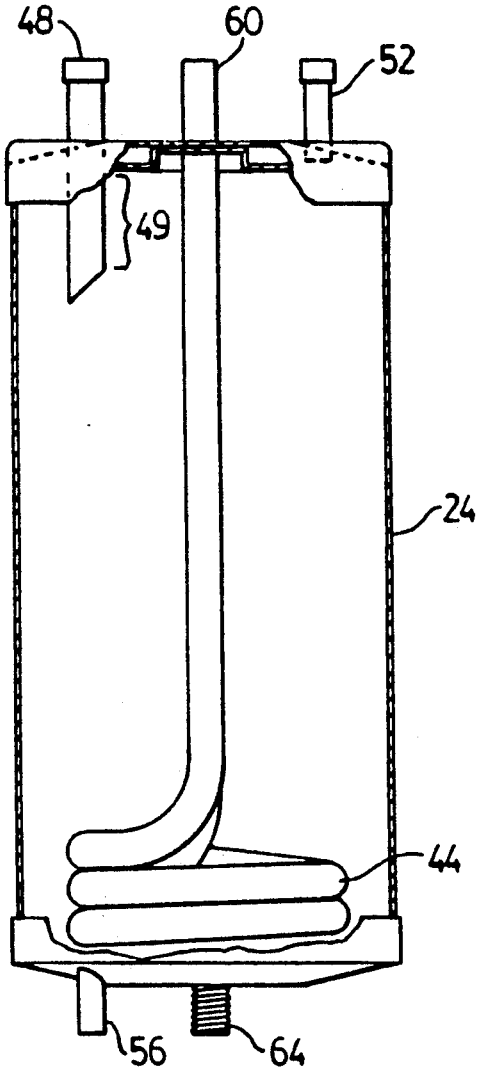
FIG. 2 shows a cut-away view of a recovery and separation unit.

FIG. 2 shows the presently preferred embodiment of recovery and separation unit 24 in more detail. Unit 24 is an insulated, vertically mounted four liter tank. As shown in the Figure, product inlet 48, which is spaced from product outlet 52, includes a portion 49 which extends into the tank while product outlet 52 is mounted flush with the top of the tank. As is also shown in the Figure, heating coil 44 comprises two coils of pressure line located adjacent the bottom of the tank and contaminant outlet 56 extends from the bottom of the tank.

This particular configuration of recovery and separation unit 24 has been found to provide the necessary performance characteristics, as will be explained in more detail below, at a reasonable cost of manufacture.

Compressor 28 may be any compressor for compressing refrigerant as will be understood by those of skill in the art. In the preferred embodiment, compressor 28 is a 280 CFM (16800 CFH) at 4.5 lb positive pressure compressor. Compressor 28 is capable of producing a vacuum of 10 inches of mercury in recovery and separation unit 24 and operates to allow system 20 to draw between 1.75 and 2.5 lbs of liquid or vapour refrigerant per minute and 5 lbs per minute or more during liquid lift.

Condenser 32 may be any suitable condenser for refrigerant as will be understood by those of skill in the art. In the preferred embodiment, condenser 32 is an air cooled 6000 BTUH capacity condenser. As will be understood by those of skill in the art, an electrically driven cooling fan (not shown) may be provided for use with condenser 32, if required.

Figure 3:
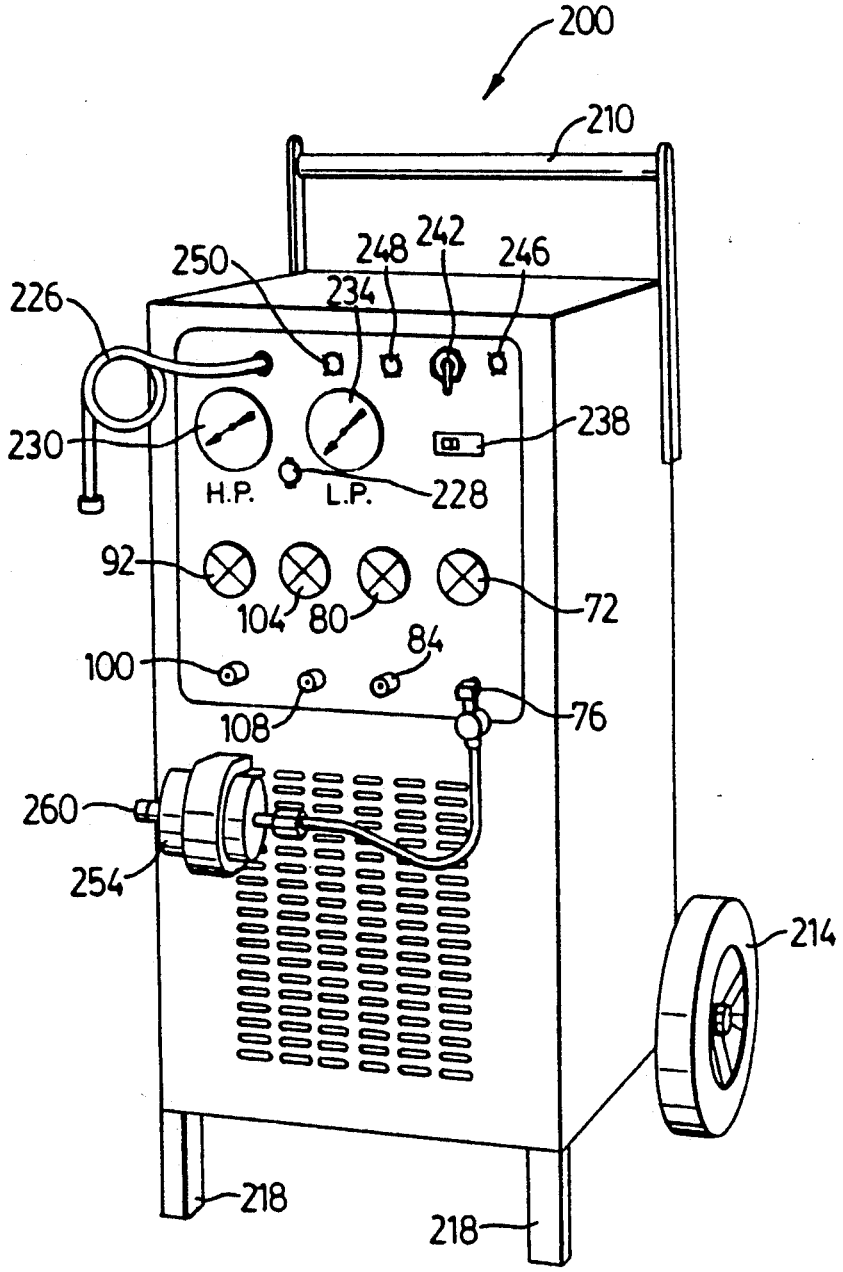
FIG. 3 shows a perspective view of an embodiment of the portable recovery and recycling system shown in FIG. 1.

A currently preferred embodiment of the present invention is indicated generally at 200 in FIG. 3. As is shown, the preferred embodiment comprises a substantially portable and self-contained unit which is provided with a handle 210, a pair of wheels 214 and a pair of front support legs 218 to allow the unit to be easily wheeled between sites.

The front panel 222 of the unit includes all of the necessary controls, connections and indicators for operating the unit, apart from the power connection lead (not shown) and a 15 amp resettable circuit breaker (not shown) which are mounted on the rear of the unit. Specifically, pressure connectors 76, 100 and 108 are located on front panel 222 as is drain connector 84. Control valves 72, 80, 92 and 104 are also conveniently located on front panel 22.

As will be discussed in further detail below, front panel 222 also includes several other components. An industry standard connector 226 for a 24 Volt DC tank access fitting and an associated override switch 228 are provided, as are a pair of pressure gauges 230, 234 which indicate the pressure on the high pressure and low pressure sides of compressor 28 respectively. Also, an hour-meter 238 is provided as is a selector switch 242, a power indicator light 246, a system evacuation indicator light 248 and a recovery indicator light 250. Each of these components, and their use is discussed in more detail below.

It is contemplated that, in most circumstances, it will be preferred to filter and/or dry refrigerant, to remove particulates and moisture, prior to entry of the refrigerant into the recovery and recycling system 20. Accordingly, a disposable filter dryer unit 254 is also provided and is preferably mounted on unit 200, adjacent front panel 222. In the preferred embodiment, filter dryer unit will remove particles as small as 25 microns in size. Filter drier unit 254 is connected between product-in connector 76 and a filter-in connector 260 which allows easy use and replacement of filter drier unit 254 as required.

The operation of the present invention will now be described with reference to the above-described preferred embodiment and FIG. 4.

Figure 4:
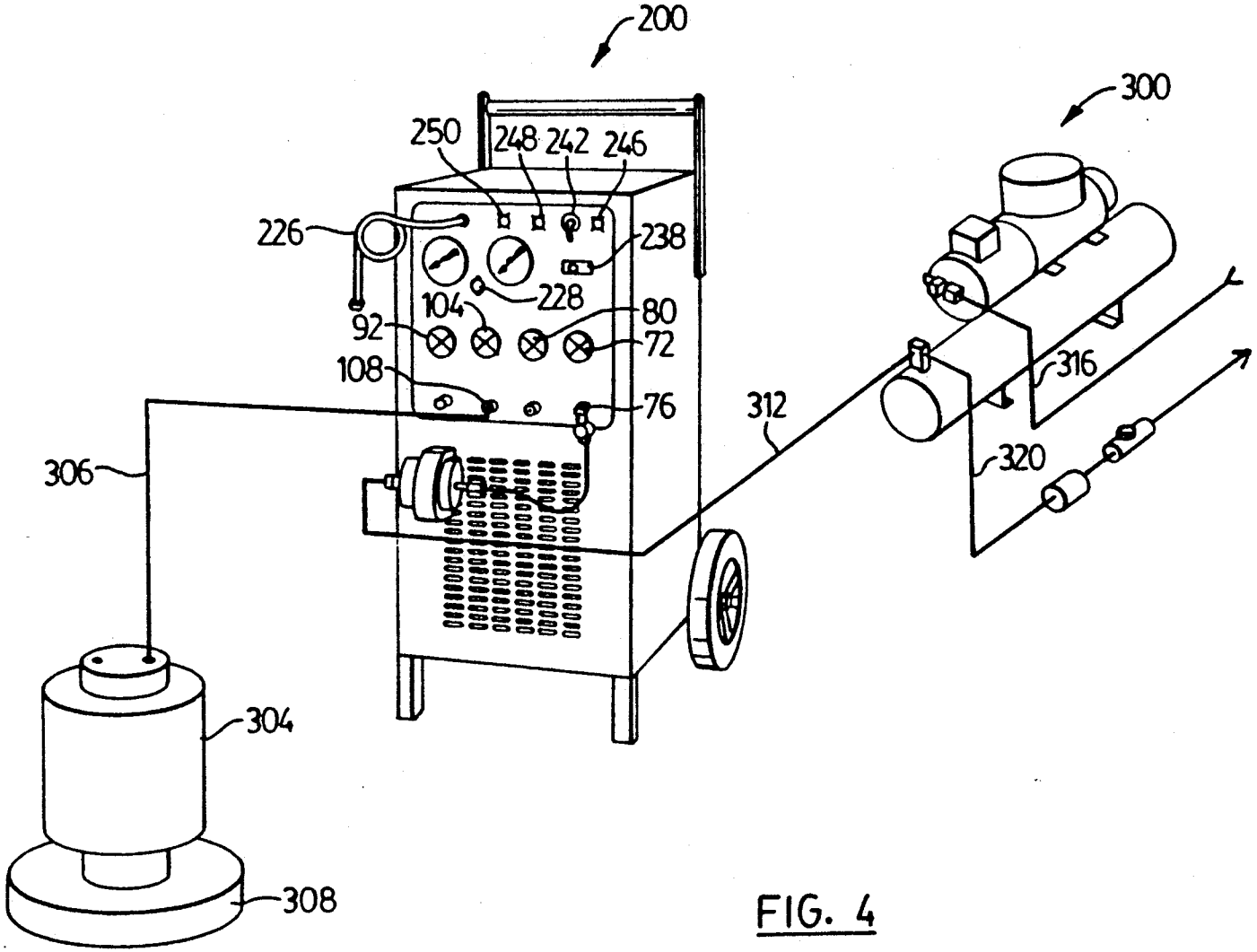
FIG. 4 shows the recovery and recycling system of FIG. 1 in use.

As shown in FIG. 4, unit 200 is moved to a location allowing convenient access to the refrigeration equipment 300 to be serviced. Valves 72, 80,92 and 104 are closed and a storage tank 304, suitable for receiving pressurized refrigerant, is connected to connector 108 by a standard pressure line 306.

In the configuration shown, storage tank 304 is not equipped with a 24 V DC tank access fitting so connector 226 is not connected to tank 304 and override switch 228 is instead activated to permit the unit 200 to operate. In this configuration, the level of refrigerant in tank 304 may be determined by a weigh scale 308 or by any other convenient method.

In configurations where tank 304 is provided with a 24 V DC tank access fitting, connector 226 would be connected to the access fitting on the tank and override switch 228 would be deactivated. As is known to those of skill in the art, such 24 V DC tank access fittings provide a signal when the tank to which they are attached reaches a level equal to 80% of the tank's capacity. When override switch 228 is deactivated, connector 226 provides unit 200 with the signal from the tank's access fitting and this signal is employed to shut-down unit 200 to avoid exceeding the 80% level. In such a case, as will be described in more detail below, the filled storage tank 304 may be disconnected and replaced with a similar empty storage tank as required.

The refrigeration equipment 300 to be serviced is connected by a standard pressure line 312 to filter dryer unit 254 which is in turn connected to liquid-in connector 76. Pressure line 312 may be connected to either the low pressure 316 or high pressure side 320 of refrigeration equipment 300 as required, although the high pressure side is generally preferred. Unit 200 is then connected to an appropriate power supply (not shown), lighting power indicator light 246 and recovery and recycling operations may commence.

Unless performed when unit 200 was last shut down, the first step in recovery and recycling is to ensure that any residual gases in unit 200 are evacuated. This is accomplished by opening evacuation control valve 92 and moving selector switch 242 to the Evacuation position.

Figure 5:
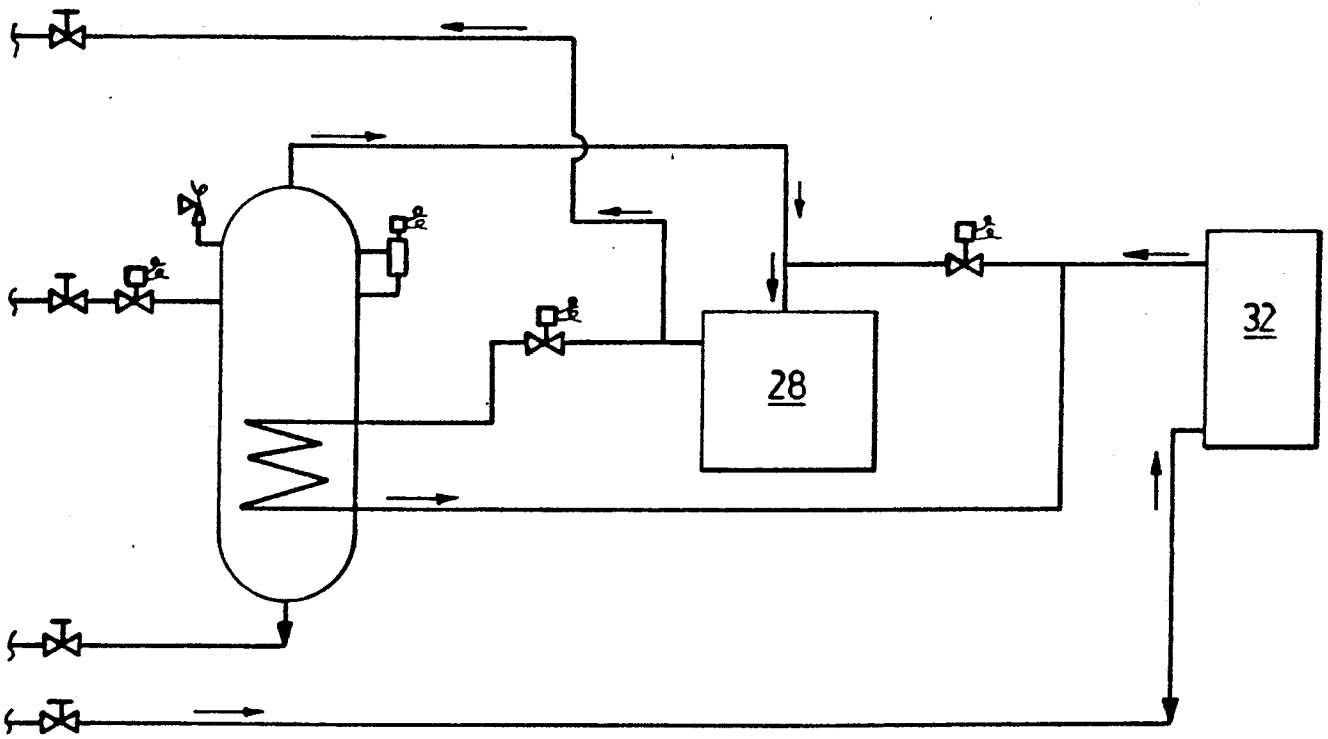
FIG. 5 shows the path of refrigerant through the system of FIG. 1 during evacuation.

Moving selector switch 242 to the Evacuation position closes discharge solenoid valve 96, opens evacuation solenoid valve 88, illuminates evacuation indicator light 248 and starts compressor 28. Any residual gases in unit 200 are thus expelled by compressor 28 through evacuation connector 100 along the path indicated by the arrows in FIG. 5. When unit 200 is substantially evacuated, which the operator may determine by monitoring the vacuum developed within unit 200 as shown by pressure gauge 234, evacuation control valve 92 is closed and selector switch 242 is moved to the off position, turning compressor 28 and evacuation indicator light 248 off.

Next, control valve 72 is opened, allowing refrigerant fluid and/or vapour to pass through pressure line 312 from equipment 300, through filter dryer unit 254 into recovery and separation unit 24. Product-out control valve 104 is opened to allow the refrigerant eventually recovered and recycled by unit 200 to enter storage tank 304. Selector switch 242 is then moved to the recovery position, opening discharge solenoid valve 96, closing evacuation solenoid 88, illuminating recovery indicator 250 and starting compressor 28.

The recovery and reclamation process proper now commences as refrigerant vapour or liquid is drawn into recovery and separation unit 24 by compressor 28 which maintains a vacuum equal to approximately ten inches of mercury in recovery and separation unit 24. When refrigerant vapour is drawn from equipment 300, recovery and separation unit 24 acts to separate out any particulate matter or other contaminants remaining in the refrigerant after passing through filter dryer unit 254. Specifically, as best seen in FIG. 2, portion 49 of product inlet 48 is spaced from, and is disposed below, product outlet 52. In this manner, refrigerant vapour which enters recovery and separation unit 24 must traverse the distance between portion 49 of product inlet 48 and product outlet 52. This distance allows particulates and other contaminants to separate from the refrigerant vapour and collect at the bottom of recovery and separation unit 24.

Figure 6:
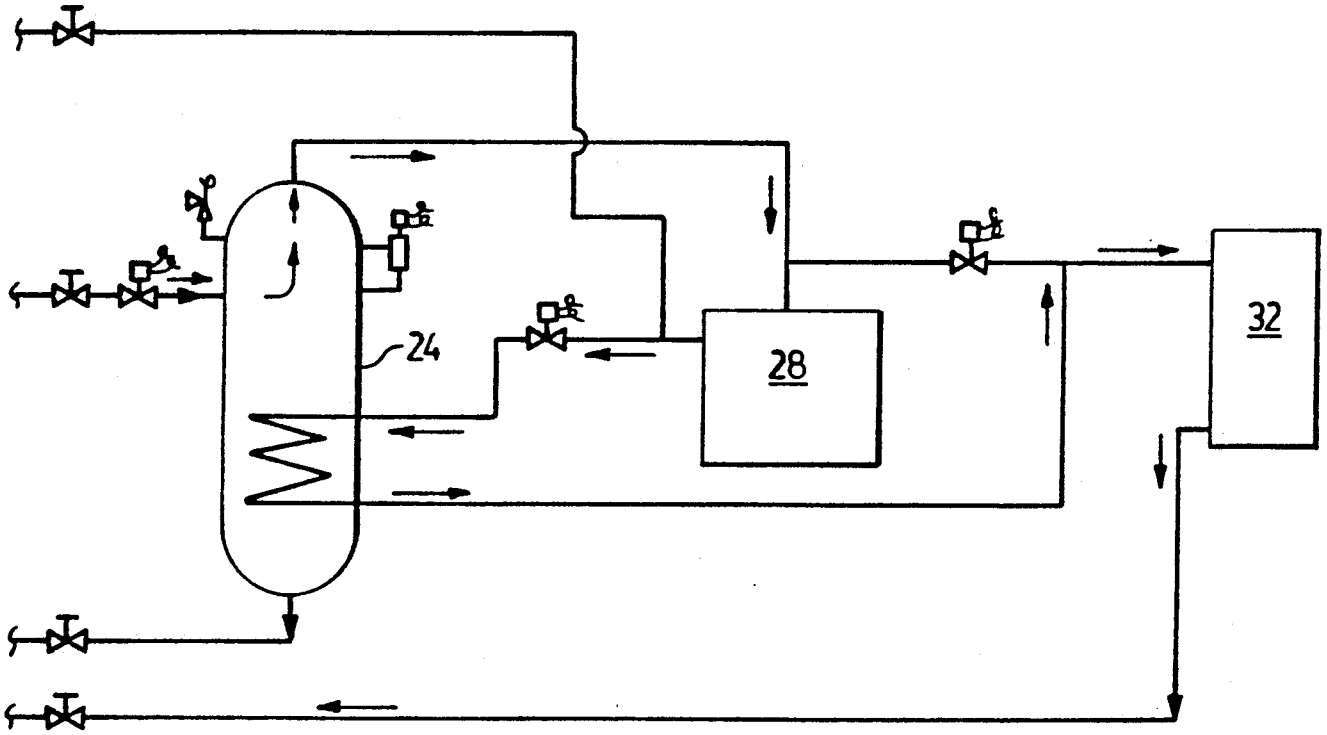
FIG. 6 shows the path of refrigerant through the system of FIG. 1 during recovery and recycling.

The refrigerant vapour is drawn from recovery and separation unit 24, through product outlet 52, into compressor 28. The refrigerant vapour is compressed to a hot, high pressure gaseous state by compressor 28 and is first circulated through heating coil 44 in recovery and separation unit 24 and then through condenser 32 before finally entering storage tank 304 through pressure line 306. The path of the refrigerant vapour through unit 200 is indicated by arrows in FIG. 6.

When liquid refrigerant is drawn from equipment 300, the liquid enters recovery and separation unit 24 where it collects. The heat from heating coil 44 and the vacuum maintained in recovery and separation unit 24 by compressor 28 result in the liquid refrigerant boiling to form refrigerant vapour which is drawn off by compressor 28 as previously described. Thus, the liquid refrigerant is distilled and any oil or other contaminants which are less volatile than the refrigerant collect at the bottom of recovery and separation unit 24.

Level sensor 40 is provided to ensure that recovery and separation unit 24 does not fill with liquid to the point were the liquid might enter product outlet 52. This prevents liquid refrigerant which has yet to be distilled and oil or other liquid contaminants which have been separated from the refrigerant from reaching compressor 28. Specifically, when the level of liquid in recovery and separation unit 24 reaches a predetermined level, level sensor 40 produces a signal which shuts product-in control solenoid valve 68 for a predefined time period which, in the preferred embodiment, is set at 32 seconds.

With product-in control solenoid valve 68 shut, distillation of the refrigerant in recovery and separation unit 24 proceeds, lowering the level of refrigerant, until the end of the predefined time period when product-in control solenoid valve 68 is again opened.

While it is not contemplated that large amounts of liquid contaminants will be collected in a single use, in the event that it is the level of separated contaminants (oil) that activates level sensor 40, level sensor 40 will immediately close product-in control solenoid valve each time the predefined time period expires. This rapid cycling of product-in control solenoid valve will be readily apparent to the operator of unit 200 who may then take steps to remove the contaminants from recovery and separation unit 24 as is described below.

As will be apparent to those of skill in the art, heating coil 44 makes use of the otherwise wasted heat energy in the refrigerant which have been compressed by compressor 28 and also reduces the BTUH capacity required for condenser 32.

If equipment 300 contains a relatively large amount of refrigerant, storage tank 304 may be filled prior to complete evacuation of equipment 300. In such a case, filled storage tank 304 may simply be exchanged for a replacement storage tank by moving selector switch 242 to the off position, closing product-out control valve 104 and detaching the full storage tank 304 from pressure line 306 and attaching a replacement empty storage tank 304 to pressure line 306. Product-out control valve 104 is then re-opened and selector switch 242 is moved back to the recovery position.

Once equipment 300 has been substantially emptied of refrigerant, as determined by monitoring the pressure on the high pressure side of compressor 28 with pressure gauge 230, product-in and product-out control valves 72 and 104 are shut and unit 200 is detached from equipment 300 and storage tank 304.

The refrigerant remaining in unit 200 is evacuated, as was described above, by moving selector switch 242 to the evacuation position and opening evacuation control valve 92. In the preferred embodiment, the pressure lines used to connect the various components of unit 200 is of a small diameter and short lengths and thus, only a minimal amount of refrigerant remains in unit 200 to be evacuated.

Once evacuated, unit 200 may be brought back to ambient pressure and the contaminants remaining in recovery and separation unit 24 may now be removed by opening contaminant-out control valve 80. As will be understood by those of skill in the art, the frequency with which contaminants need be removed from unit 200 will vary depending upon the particular equipment 300 from which the refrigerant are recovered and the degree to which the refrigerant had been contaminated. It is contemplated that hour-meter 238 will provide a useful indication as to when such removal need be effected.

It is preferred that unit 200 be evacuated of refrigerant after each use to allow removal of contaminants and to ensure that refrigerant is not vented to the atmosphere.

The present invention provides an additional function which it is contemplated will prove to be useful. In the past, refrigeration equipment was charged with refrigerant by connecting the low pressure side of the equipment to a supply of virgin refrigerant and allowing the refrigerant to be vaporized and drawn into the refrigeration equipment by the equipment's compressor. However, some refrigeration equipment now in use employs SUVA refrigerants which include a blend of three different CFC compounds with differing physical characteristics (including their volatility). Thus, if attempts are made to charge refrigeration equipment in the conventional manner with SUVA refrigerants, the most volatile components of the blend charge the system while the components with a lower degree of volatility remain in the supply tank. This obviously results in an improper SUVA mixture in the refrigeration equipment.

With the present invention, the liquid out connector of a supply of SUVA refrigerant may be connected to product-in connector 76 and the high pressure side of the equipment to be charged may be connected to product-out connector 108. The unit, in accordance with the present invention, is then operated in the recovery mode, as described above, to actively 'pump' liquid SUVA refrigerant from a supply tank into the recovery and separation unit and then to the refrigeration equipment. In this fashion, the SUVA refrigerant is drawn from the supply in the liquid state, ensuring the proper mixture, before being pressurized and supplied to the refrigeration equipment.

It will be apparent from the discussion above that the present invention provides a novel system and method for the recovery and recycling of refrigerants such as otherwise environmentally damaging CFC compounds. It will also be apparent that, while a particular preferred embodiment of the present invention is described herein, variations and modifications will occur to those of skill in the art and should not be considered as departing from the spirit of the invention.

I claim:

1. A method of recovering and recycling refrigerant from refrigeration equipment comprising the steps of:

connecting a separation unit to said equipment through a first valve means;

drawing gas from said separation unit to create a reduced pressure in said separation unit, said reduced pressure inducing flow of refrigerant and contaminants from said equipment into said separation unit;

pressurizing said gas drawn from said separation unit into a storage vessel through a second valve means;

closing said first and second valve means to drain the contaminants remaining in the separation unit after said refrigerant has been recovered.

2. The method of claim 1 further comprising the step of heating liquid refrigerant drawn into said separation unit to aid vaporization and separation of the refrigerant from the contaminants.

3. The method of claim 2 further comprising the step of monitoring the level of liquid refrigerant and contaminants in said separation unit and closing said first valve means for a predetermined time when a predefined level in said separation unit is exceeded while continuing to draw gas from said separation unit.

4. The method of claim 2 wherein at least a portion of the heat energy for said heating step is produced by said pressurization of the gas drawn from said separation means.

5. The method of claim 1 further comprising the step of evacuating refrigerant remaining in the separation unit once said recovery and recycling is substantially completed.

* * * * *